US008166681B2

(12) United States Patent
Janakiraman et al.

(10) Patent No.: US 8,166,681 B2
(45) Date of Patent: May 1, 2012

(54) SOLEPLATE

(75) Inventors: Chandra Mohan Janakiraman, Evanston, IL (US); Yong Jiang, Hoogeveen (NL); Job Van Der Burg, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 765 days.

(21) Appl. No.: 12/300,804

(22) PCT Filed: May 16, 2007

(86) PCT No.: PCT/IB2007/051870

§ 371 (c)(1),
(2), (4) Date: Nov. 14, 2008

(87) PCT Pub. No.: WO2007/135631

PCT Pub. Date: Nov. 29, 2007

(65) Prior Publication Data

US 2009/0165341 A1 Jul. 2, 2009

(30) Foreign Application Priority Data

May 16, 2006 (EP) ..... 06114015

(51) Int. Cl.
*D06F 75/38* (2006.01)
*D06F 75/08* (2006.01)

(52) U.S. Cl. ..... 38/93

(58) Field of Classification Search ..... 38/74, 77.83, 38/77.9, 85, 93, 97, 98; 219/245, 259; 428/653, 428/654

See application file for complete search history.

(56) References Cited

U.S. PATENT DOCUMENTS

| | | | | |
|---|---|---|---|---|
| 2,846,793 | A * | 8/1958 | Studer | 38/77.9 |
| 3,979,572 | A | 9/1976 | Ito et al. | |
| 5,391,859 | A * | 2/1995 | Hazan et al. | 219/250 |
| 5,721,418 | A * | 2/1998 | Hazan et al. | 219/257 |
| 6,122,849 | A | 9/2000 | Kida et al. | |
| 6,901,687 | B2 * | 6/2005 | Krings et al. | 38/93 |
| 2004/0229079 | A1 * | 11/2004 | Groll | 428/653 |
| 2004/0245244 | A1 | 12/2004 | Hirota et al. | |
| 2005/0208272 | A1 | 9/2005 | Groll | |
| 2007/0256336 | A1 * | 11/2007 | Choi | 38/82 |

FOREIGN PATENT DOCUMENTS

| | | | |
|---|---|---|---|
| CN | 88210305 | U | 12/1988 |
| CN | 1370886 | A | 9/2002 |
| JP | 1313100 | A | 12/1989 |
| JP | 910498 | | 1/1997 |
| WO | 2006021101 | A1 | 3/2006 |

* cited by examiner

*Primary Examiner* — Ismael Izaguirre

(57) ABSTRACT

A soleplate includes a metallic layer, a non-ferromagnetic layer and a ferromagnetic layer sandwiched between the metallic layer and non-ferromagnetic layer. The soleplate is used in an induction heating-based cordless iron. The electromagnetic field from an induction coil located in a stand, where the iron rests and gets charged, can pass beyond the non-ferromagnetic layer and heat the ferromagnetic layer efficiently. The non-ferromagnetic layer that is forming an ironing plate ensures a uniform heat transfer to the metallic layer for good steaming performance for effective cordless ironing.

17 Claims, 2 Drawing Sheets

SOLEPLATE

The invention relates to a soleplate, more particularly to a soleplate used in an induction-based cordless iron.

A cordless iron permits ironing without the iron being connected by a cord to a power source during the active ironing phases.

Such an iron has most often an internal heating element. The cordless iron receives the necessary energy by an electromagnetic induction coil situated in a stand on which the iron rests when no ironing is performed. The induction coil heats the iron and thereby the energy that is necessary for the following active phase of ironing gets accumulated in the iron.

The energy available in the iron is used for heating a soleplate. If the iron is also designed to generate steam, the maximum steam rate is determined by the amount of energy that can be stored in the iron. Typically, at a steam rate of about 15-20 gm/min, half the energy is required for the ironing process and the other half is required for generating the steam. The metals that can be heated efficiently in an electromagnetic induction-heating device are ferromagnetic metals. Usually, such metals have poor heat conduction. This results in a non-uniform heat distribution. Moreover, metals such as iron and stainless steel have a high specific weight, thus making the cordless iron heavy and difficult to use. Further, these metals cannot be die cast and this limits the use of steel for the entire soleplate.

JP01313100 describes an induction-based cordless iron wherein a ferromagnetic layer is joined to a layer that is made of a substance having a good thermal conductivity such as aluminum. Both these layers together form a soleplate of the iron. The ferromagnetic layer that faces away from the housing of the iron and is in contact with the garment also forms an ironing plate of the iron. When ferromagnetic material is used for the ironing plate, said ironing plate becomes quite hot because of inadequate heat transfer to the metallic layer. This is the side of the cordless iron where the temperature is measured to control the power to be supplied to the iron when the iron is placed in the stand for charging. When this side becomes very hot because of a non-uniform heat transfer, the power gets cut-off, causing the top parts of the soleplate to become cooler. In such a case, the energy that gets accumulated in the iron may not be enough to generate the steam. Further, when the ironing plate becomes very hot, the clothing to be ironed becomes scalded due to temperature overshoot.

It is an object of the invention to provide a soleplate that is capable of being heated efficiently by electromagnetic induction and can retain the heat for effective cordless performance.

This object is achieved by features of the independent claim. Further developments and preferred embodiments of the invention are outlined in the dependent claims.

In accordance with a first aspect of the invention, there is provided a soleplate comprising a metallic layer, a non-ferromagnetic layer and a ferromagnetic layer that is sandwiched between the metallic layer and the non-ferromagnetic layer. An induction coil is usually provided in the stand and is used to heat the cordless iron when the iron is in rest. It is ensured that the ferromagnetic layer is not the closest to the induction coil but is preceded by a non-ferromagnetic layer i.e., the non-ferromagnetic layer is in between the ferromagnetic layer and the induction coil. The non-ferromagnetic layer that forms the ironing plate ensures a uniform heat transfer to the metallic layer for good steaming performance for effective cordless ironing. As the non-ferromagnetic layer does not get heated up, the iron can be charged effectively ensuring that the soleplate is hot enough for further ironing. The energy that gets accumulated in the iron is enough to generate the steam. As the ironing plate does not become very hot, the clothing to be ironed does not become scalded due to temperature overshoot. The ferromagnetic material may be any induction-heatable material. The ferromagnetic layer is joined to the metallic layer either by riveting and/or brazing and/or by diffusion bonding with metal-based high thermal conductivity paste in between said layers. These alternative processing steps are well proven methods of joining different metals. Furthermore, metal-filled adhesives provide a joint with a high thermal conductivity and a good thermal contact.

According to a particular embodiment of the invention, the metallic layer has a specific heat of at least 900 J/kg K and a thermal conductivity of at least 150 W/m K. The specific heat of the metallic layer increases the heat carrying capacity at a given temperature. The thermal conductivity enables a uniform heat distribution and avoids hot spots. It also enables efficient heat transfer to a steam chamber to avoid steam spitting. In this regard, it is advantageous that the metallic layer comprises aluminum or magnesium. These metals combine a good thermal conductivity and a good specific heat with good processing properties.

According to another embodiment of the invention, the non-ferromagnetic layer has a thickness not more than one skin depth and the ferromagnetic layer has a thickness of three times the skin depth. The thickness of any layer is defined by means of skin depth.

The skin depth can be calculated as:

$$\delta = \sqrt{\frac{\rho}{\pi * f * \mu}}$$

Where $\delta$ is the skin depth in meter, $\rho$ is the resistivity of the layer in micro-Ohm meter, f is the frequency of the current in the coil in Hz, $\mu$ is the absolute magnetic permeability of the layer in Henry/meter.

The thicknesses of the non-ferromagnetic layer and the ferromagnetic layer are chosen such that an electro-magnetic field from the induction coil can pass beyond the non-ferromagnetic layer and heat the ferromagnetic layer efficiently. The electromagnetic field from the induction coil extends upward in space. The highest induction-heating efficiency is obtained when most of the field is forced to pass through a ferromagnetic layer. However, since the non-ferromagnetic layer is between the induction coil and the ferromagnetic layer, the field has to penetrate through this layer before it can heat the ferromagnetic layer. Hence, the non-ferromagnetic layer cannot completely include the field, i.e. it should allow the field to penetrate through it so that the field extends beyond its thickness and can reach the ferromagnetic layer above. The ferromagnetic layer would then almost completely include the field i.e., it captures the field or forces most of the field to pass through it to maximize the heating efficiency. So, the non-ferromagnetic layer has to be thin and the ferromagnetic layer has to be thick. These thicknesses ensure that almost the full magnetic field passes through the ferromagnetic layer that is needed for efficient induction heating.

The thicknesses chosen for the ferromagnetic layer and the non-ferromagnetic layer also ensure that the electromagnetic field transfers heat to the non-ferromagnetic layer and the ferromagnetic layer in such a ratio as to restore the energy lost by each one of them during the previous ironing cycle. For instance, the non-ferromagnetic layer that forms the ironing plate could lose energy to the garment, and the metallic layer that is in contact with the steam generator could lose energy in the process of steam generation.

According to yet another embodiment of the invention, the non-ferromagnetic layer has an electrical resistivity of at least 0.4 micro-Ohm meter and a relative magnetic permeability of at least 1. The non-ferromagnetic layer preferably has a resistivity and a relative magnetic permeability such that effective heating by the electromagnetic induction at typical frequencies is ensured. The higher the resistivity, the better the heating efficiency is. The relative magnetic permeability of the non-ferromagnetic layer is preferably 1, indicating that it is basically non-magnetic. The non-ferromagnetic layer should also retain the heat needed for active phases of ironing. Ceramics or high-temperature plastics are good thermal insulators as they are non-metals and can be used as non-ferromagnetic layers. The non-ferromagnetic layer is joined to the ferromagnetic layer by force-wrapping the sheet around the ferromagnetic layer. Other mechanical methods such as riveting can also be used. An insulating paste or a low thermal conductivity paste is situated between the ferromagnetic layer and the non-ferromagnetic layer to improve heat retention of the soleplate. Silicone- or epoxy-based pastes are used as insulating pastes.

According to yet another embodiment, ferromagnetic and non-ferromagnetic layers are comprised in a sheet of clad metal. The soleplate is made by joining a commercially available sheet of clad metal to the metallic layer either by riveting and/or brazing and/or by diffusion bonding with a metal-based high thermal conductivity paste in between said sheet and said layer. The clad metal is a readily available induction-optimized commercial clad metal.

According to a still further embodiment, the clad metal is sandwiched between two layers of aluminum. The top layer of aluminum enables good integral bonding with the metallic layer. This is due to the cohesion of similar materials and also due to the comparable coefficients of thermal expansion. The bottom aluminum layer that faces towards the garment is an extremely thin layer, i.e. the thickness being in the order of microns. It is so thin that it does neither affect the heat transfer to the metallic layer nor the heat retention properties of the soleplate.

According to a still further embodiment, the bottom layer of aluminum, which is in contact with the garment during active phases of ironing, is provided with a decorative coating. This aluminum layer enables the application of the decorative coating.

According to a particular embodiment, the decorative coating is a PTFE or sol-gel layer. This coating over the thin aluminum layer enables gliding of the iron over the garment and improves the aesthetic properties of the iron.

According to another embodiment, a metal-based thermal conductivity paste is situated between the metallic layer and the ferromagnetic layer. This paste ensures that the ferromagnetic layer has very good thermal contact with the metallic layer.

According to another embodiment, an insulating paste is situated between the ferromagnetic layer and the non-ferromagnetic layer. These pastes, being poor conductors of heat, reduce the heat losses and improve the heat retention of the soleplate. It is advantageous when the insulating pastes comprise silicone- or epoxy-based pastes.

In a further embodiment, a soleplate according to the invention is comprised in a cordless iron.

In a still further embodiment, the cordless iron is provided with control means for controlling generation of steam. As energy is very precious in a cordless iron, the steam may not be generated when the iron is returned to the stand for charging which implies that the function of steaming is only on demand or is based on the motion of the iron. This ensures that there is no energy loss due to steam generation while the iron is in the stand, and the charging of the iron while in the stand is efficient. The steam is generated only when a user depresses a steam trigger button.

Various features, aspects and advantages will be clearly understood from the following description with reference to the accompanying drawings, wherein.

Figure 1:
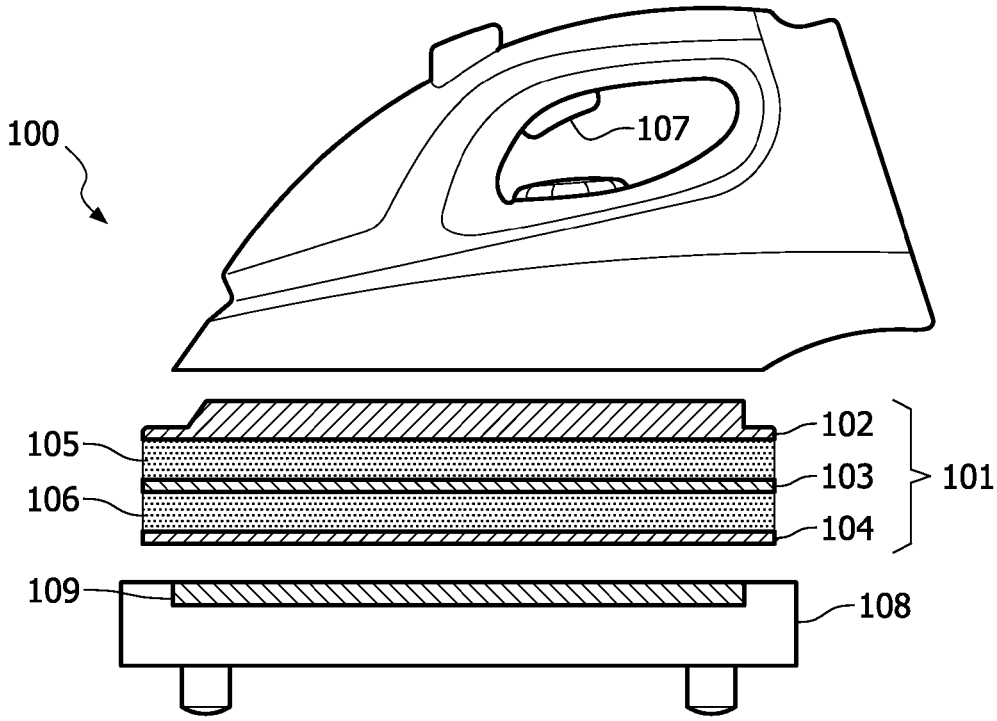
FIG. 1 depicts a first embodiment of a soleplate according to the invention, used in a cordless iron.

Referring to the drawings, the embodiments of the cordless iron will now be described.

In FIG. 1, a cordless iron 100 comprising a soleplate 101 made up of a plurality of layers is shown, wherein 102 is a metallic layer, 104 is a non-ferromagnetic layer and 103 is an induction-heatable ferromagnetic layer sandwiched between the metallic 102 and the non-ferromagnetic layers 104. A metal-based high thermal conductivity paste 105 is situated between the metallic layer 102 and the ferromagnetic layer 103. An insulating paste 106 is situated between the ferromagnetic layer 103 and non-ferromagnetic layer 104. The iron is also provided with a steam trigger 107. FIG. 1 also shows a stand 108 comprising an induction coil 109.

According to an embodiment of the invention, the soleplate 101 is made by sandwiching a ferromagnetic layer 103 between a high specific heat, high thermal conductivity metallic layer 102 and a high resistance, non-ferromagnetic layer 104. The ferromagnetic material may be any induction-heatable material, for example, stainless steel of appropriate grade such as SS 430. A metallic layer 102 made of a metal with a specific heat of at least 900 J/kg K and a thermal conductivity of at least 150 W/m K is used. Any metallic layer with a lower thermal conductivity prevents uniform heat distribution in the lateral direction, thereby causing hot spots. It also prevents the heat transfer to the steam chamber, causing poor steam generation or even steam spitting. Low specific heat of the metallic layer severely reduces the heat-carrying capacity at a given temperature. Aluminum and magnesium are metals with a high thermal conductivity and a high specific heat and can be used as the metallic layers. Further, these metals make mass production such as die-casting easier. The ferromagnetic layer 103 is joined to the metallic layer 102 either by riveting and/or brazing and/or by diffusion bonding with a metal-based high thermal conductivity paste 105 in between said layers. This paste ensures that the ferromagnetic layer 103 has very good thermal contact with the metallic layer 102. Metal-based high thermal conductivity pastes 105 are usually metal-filled epoxy-based pastes. Pyro-Duct™ 597-A and 597-C or Pyro-Duct™ 598-A and 598-C from AREMCO are a few examples of such pastes. These are electrically and thermally conductive, silver- or nickel-filled pastes used as adhesives or coatings in the temperature range of 1000-1700° F.

The non-ferromagnetic layer 104 preferably has a resistivity of at least 0.4 micro-Ohm meter and a relative magnetic permeability of at least 1. This value of resistivity ensures effective heating by the electromagnetic induction at typical frequencies. Austenitic steel such as SS 304 or titanium or high-temperature plastics and ceramics are used for fabricating the non-ferromagnetic layer. The non-ferromagnetic layer 104 is joined to the ferromagnetic layer 103 by force-wrapping the sheet all around the ferromagnetic layer. Other mechanical methods such as riveting can also be used. An insulating paste or a low thermal conductivity paste 106 is situated between the ferromagnetic layer and the non-ferromagnetic layer. Silicone- or epoxy-based pastes are used as insulating pastes. Durapot™ 866 is a thermally and electrically insulating compound and is an example of the insulating paste. These pastes improve heat retention of the soleplate.

The induction coil 109 is usually provided in the stand 108 and is used to heat the cordless iron when the iron is in rest. The non-ferromagnetic layer 104 is in between the ferromagnetic layer 103 and the induction coil 109. In other words, the non-ferromagnetic layer 104 forms the lowermost layer and is in contact with the induction coil 109. It also forms the ironing plate. This enables better heat transfer to the metallic layer 102 for good steaming performance and also for better heat retention. Ceramics or high-temperature plastics are good thermal insulators as they are non-metals and can be used as non-ferromagnetic layers as mentioned above. The heat retention can further be improved by situating an insulating paste in between the ferromagnetic layer and the non-ferromagnetic layer.

The thickness of the ferromagnetic layer has to be greater than 3 skin depths to capture the full field, whereas the non-ferromagnetic layer has to be thinner than one skin-depth at the design frequency to allow field penetration.

Figure 2:
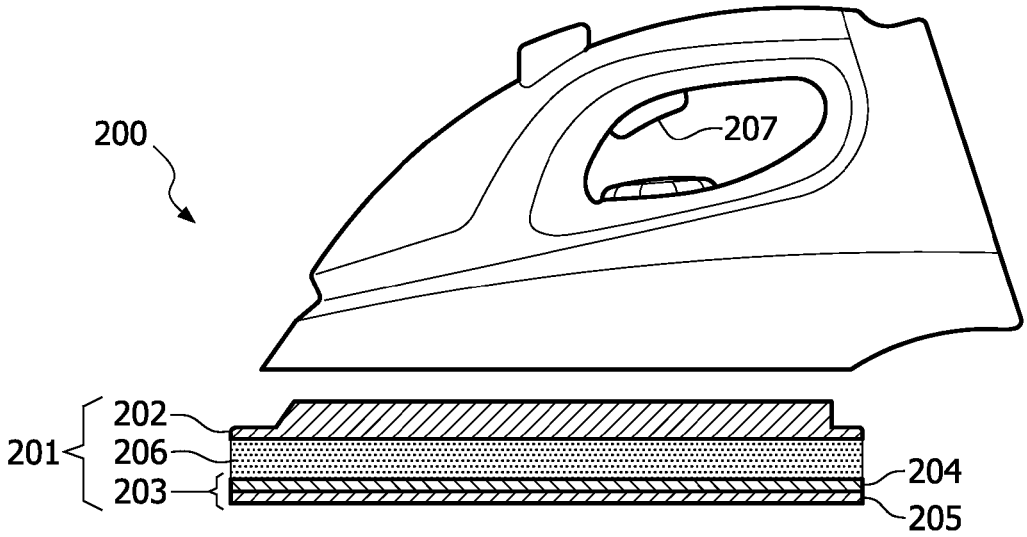
FIG. 2 depicts a second embodiment of a soleplate according to the invention, used in a cordless iron.

In FIG. 2, a cordless iron 200 comprising a soleplate 201 is shown. The soleplate is made up of a plurality of layers, wherein 202 is a metallic layer and 203 is a sheet of clad metal. The sheet of clad metal comprises a ferromagnetic layer 204 and a non-ferromagnetic layer 205. A metal-based high thermal conductivity paste 206 is placed between the metallic layer 202 and the sheet of clad metal 203. A steam trigger 207 is provided on the cordless iron 200.

According to another embodiment, the soleplate 201 is made by joining a commercially available sheet of clad metal 203 to the metallic layer 202 either by riveting and/or brazing and/or by diffusion bonding with a metal-based high thermal conductivity paste 206 in between the sheet and the layer. The clad metal 203 is a readily available induction-optimized commercial clad metal such as ALCOR™ 7 Ply. It combines the durability and appearance of non-ferromagnetic materials with ferromagnetic materials. ALCOR™ 7 offers a combination of properties suitable for induction-based heating. The magnetic or induction properties of ALCOR™ 7 are obtained from the special ferromagnetic layer under the thin non-ferromagnetic outer layer.

Figure 3:
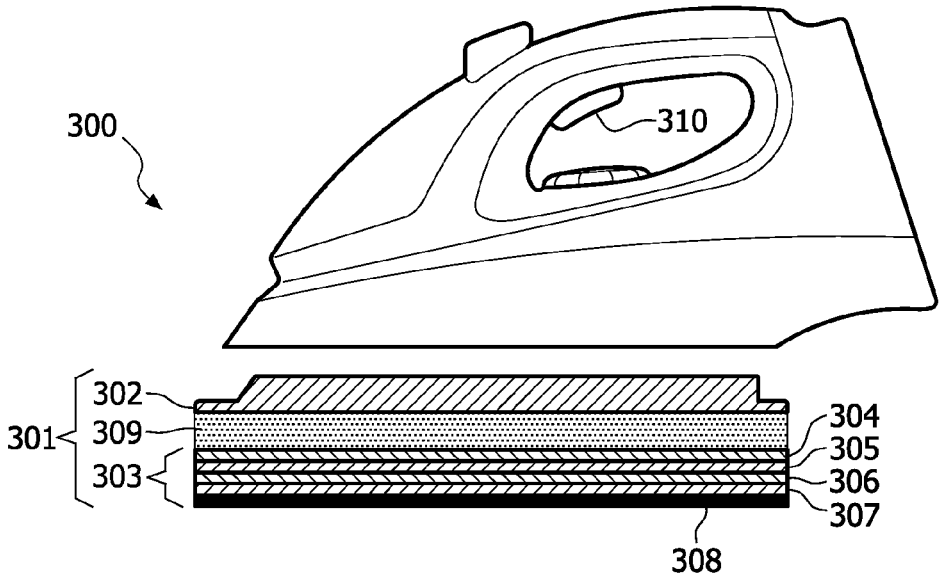
FIG. 3 depicts a third embodiment of a soleplate according to the invention, used in a cordless iron.

In FIG. 3, a cordless iron 300 comprising a soleplate 301 is shown. The soleplate is made up of a plurality of layers, wherein 302 is a metallic layer and 303 is a sheet of clad metal. The sheet of clad metal 303 comprises an aluminum layer 304, a ferromagnetic layer 305, a non-ferromagnetic layer 306 and an extremely thin aluminum layer 307 that enables the coating of PTFE or sol-gel layer 308. A metal-based high thermal conductivity paste 309 is placed between the metallic layer and the sheet of clad metal. A steam trigger 310 is provided on the iron.

According to a further embodiment, the soleplate 301 is made by joining a sheet of clad metal 303 to the metallic layer 302 either by riveting and/or brazing and/or by diffusion bonding with a metal-based high thermal conductivity paste 309 in between the sheet and the layer. In this embodiment, the sheet of clad metal ALCOR™ 7 mentioned in the second embodiment is sandwiched between two aluminum layers. The aluminum layer 304 facing the metallic layer enables good integral bonding to the metallic layer due to the cohesion of similar materials and also due to the comparable coefficients of thermal expansion. The extremely thin layer of aluminum 307 facing the garment enables a coating of PTFE or a sol-gel layer 308 to be applied over it so that gliding and aesthetic properties are obtained.

Figure 4:
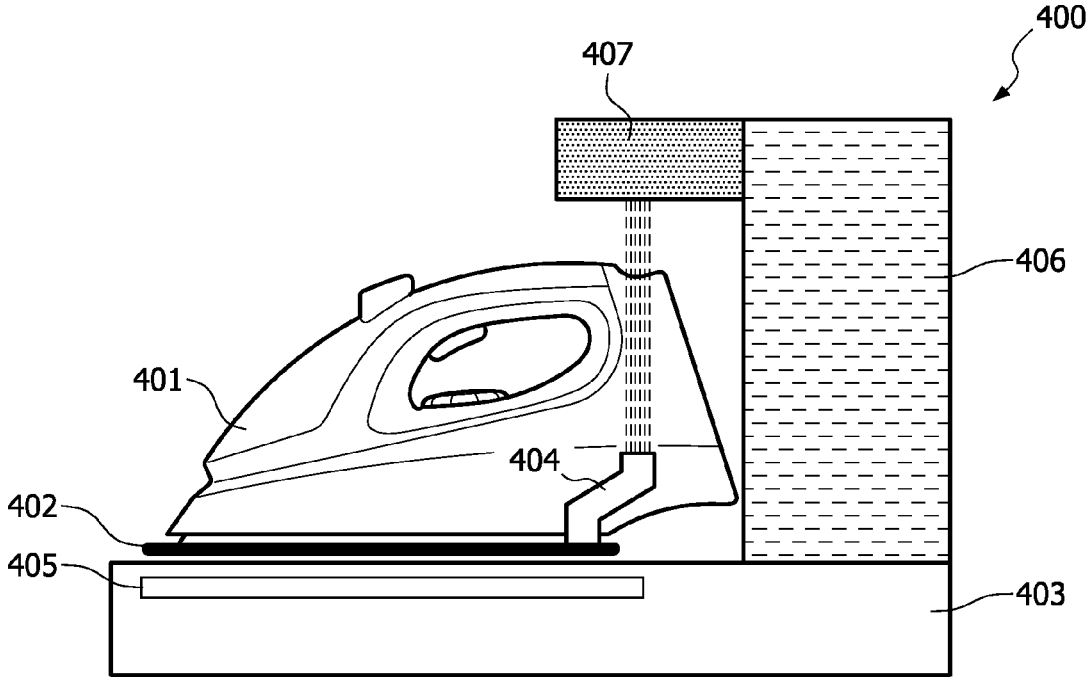
FIG. 4 depicts an ironing system comprising a cordless iron, a water-refilling arrangement and a base with an induction coil.

In FIG. 4, an ironing system 400 comprising a cordless iron 401 and a stand 403 is shown. The cordless iron 401 comprises a soleplate 402 as described in any one of the above-mentioned Figures. The iron comprises a water tank 404. The stand 403 is provided with an induction coil 405 and a water storage tank 406 and a refill button 407.

A water storage tank 406 can be provided in the stand 403 such that a smaller tank 404 inside the iron 401 can be refilled using a refill button 407. This could be a manual or an automatic water-delivery system.

Further, as energy is very precious in a cordless iron, the steam function may be switched off when the iron is returned to the stand for charging. This means that the function of steaming is only on demand or is based on the motion of the iron. This ensures that there is no energy loss due to steam generation while the iron is in the stand, and the charging of the iron while in the stand is efficient. The steam is generated only when the user depresses a steam trigger button 107 or 207 or 310 provided on the iron, depending on the embodiment chosen. The steam generation is achieved by a mechanical control of a dosing point or by a mechanical control of a de-airing hole or by an electronic control (e.g. used with a pump) in combination with an electronic hand sensor. The electronic hand sensor senses the hand on the iron handle and triggers the pump to start pumping.

The performance of the cordless iron improves with an increasing weight of the soleplate. However, a very heavy iron will cause an inconvenience to the user. A soleplate having a weight in the range of 800-1000 g is ideal as it enables longer autonomy off the stand.

The power of the induction coil should preferably be high, so that the energy is efficiently transferred from the induction coil to the iron in a short charging cycle and the soleplate temperature is restored for prolonged ironing autonomy. The power of the induction coil may be in the range of 1000-3000 W.

The soleplate as described in the above embodiments can be used in any appliance using induction-based heating. It is used in irons with or without steam-generating function and can also be used in corded irons. It is also applicable to a system iron wherein the steam is supplied to the iron through a hose connecting the iron and a boiler system that generates steam, but the soleplate is heated by the induction coil when placed on the stand.

Equivalents and modifications not described above may also be employed without departing from the scope of the invention, which is defined in the accompanying claims.

The invention claimed is:

1. A soleplate comprising a metallic layer, a non-ferromagnetic layer and a ferromagnetic layer sandwiched between said metallic layer and said non-ferromagnetic layer, wherein a metal-based thermal conductivity paste is situated between said metallic layer and said ferromagnetic layer.

2. The soleplate of claim 1, wherein said metallic layer has a specific heat of at least 900 J/kg K and a thermal conductivity of at least 150 W/m K.

3. The soleplate of claim 1, wherein said non-ferromagnetic layer has a thickness not more than one skin depth and said ferromagnetic layer has a thickness of at least three times the skin depth.

4. The soleplate of claim 1, wherein said non-ferromagnetic layer has an electrical resistivity of at least 0.4 micro-Ohm meter and a relative magnetic permeability of at least 1.

5. The soleplate of claim 1, wherein said ferromagnetic and said non-ferromagnetic layer are comprised in a sheet of clad metal.

6. The soleplate of claim 5, wherein said clad metal is sandwiched between two layers of aluminum.

7. The soleplate of claim 6, wherein one of said layers of aluminum, which is in contact with a garment during the active phase of ironing, is provided with a decorative coating.

8. The soleplate of claim 7, wherein said decorative coating is a PTFE or sol gel.

9. The soleplate of claim 1, wherein said metal-based paste is a metal-filled epoxy-based paste.

10. The soleplate of claim 1, wherein an insulating paste is situated between said ferromagnetic layer and said non-ferromagnetic layer.

11. The soleplate of claim 10, wherein said insulating paste is a silicone-based paste or an epoxy-based paste.

12. A cordless iron comprising the soleplate of claim 1.

13. The cordless iron of claim 12, wherein control means are provided for controlling steam generation.

14. A soleplate comprising:

a first metallic layer;

a non-ferromagnetic layer;

a ferromagnetic layer sandwiched between the first metallic layer and the non-ferromagnetic layer;

a second metallic layer located over the non-ferromagnetic layer; and a sol gel layer located over the second metallic layer.

15. The soleplate of claim 14, further comprising a third metallic layer sandwiched between the first metallic layer and the ferromagnetic layer.

16. The soleplate of claim 14, wherein the second metallic layer and the third metallic layer comprises aluminum.

17. The soleplate of claim 16, wherein the second metallic layer is thinner than the third metallic layer.

* * * * *